US005535175A

United States Patent [19]

Niimi

[11] Patent Number: 5,535,175

[45] Date of Patent: Jul. 9, 1996

[54] STATIONARY TYPE MIXING APPARATUS

[75] Inventor: Tomio Niimi, Nagoya, Japan

[73] Assignees: Kankyokagakukogyo Kabushiki Kaisha; Hitoshi Imai, both of Nagoya, Japan

[21] Appl. No.: 517,748

[22] Filed: Aug. 22, 1995

[30] Foreign Application Priority Data

Aug. 24, 1994 [JP] Japan ..... 6-224269

[51] Int. Cl.[6] ..... B01F 13/00

[52] U.S. Cl. ..... 366/336; 138/42

[58] Field of Search ..... 366/336, 337, 366/338, 339, 340; 138/37, 38, 42, 43

[56] References Cited

U.S. PATENT DOCUMENTS

| | | | |
|---|---|---|---|
| 2,576,733 | 11/1951 | Vasold | 366/338 |
| 2,815,532 | 12/1957 | Braunlich | 366/336 |
| 3,941,355 | 3/1976 | Simpson | 366/336 |
| 3,942,765 | 3/1976 | Henrickson | 366/336 |
| 4,299,655 | 11/1981 | Skaugen | 366/336 |
| 4,964,733 | 10/1990 | Fredriksson | 366/336 |
| 5,407,274 | 4/1995 | Woerheide | 138/42 |

*Primary Examiner*—Robert W. Jenkins

*Attorney, Agent, or Firm*—Flynn, Thiel, Boutell & Tanis

[57] ABSTRACT

A stationary type mixing apparatus capable of mixing fluids having high viscosity and improving mixing efficiency of plural kinds of fluids. The stationary type mixing apparatus comprises double fluid unit bodies, each of the double fluid unit bodies composed of a frustoconical outer cylindrical unit body having a large diameter, the body including a frustoconical outer cylindrical body, a frustoconial inner cylindrical unit body having a diameter being smaller than that of the outer cylindrical unit body, the body including a frustoconical inner cylindrical body, wherein the inner cylindrical unit body is inserted concentrically in an inner space of the outer cylindrical unit body so as to form a passage space between the outer cylindrical unit body and the inner cylindrical unit body, a plurality of small chambers arranged on an inner peripheral surface *6a* of the outer cylindrical body and opened at fronts thereof, and a plurality of small chambers arranged on an outer peripheral surface of the inner cylindrical body and opened at fronts thereof, wherein the small chambers of the inner cylindrical unit body and the small chambers of the outer cylindrical unit body are arranged alternately face to face so as to communicate with one another in a state where the inner cylindrical unit body is concentrically inserted into the inner space of the outer cylindrical unit body.

10 Claims, 18 Drawing Sheets

STATIONARY TYPE MIXING APPARATUS

BACKGROUND OF THE INVENTION

1. Field of the Invention

The present invention relates to a stationary type mixing apparatus capable of mixing fluids such as liquefied products (hereinafter referred to simply as fluids) having high viscosity and improving fiber property and orienting property of inner structures of the fluids.

2. Prior Art

A prior art stationary type mixing apparatus is shown in FIG. 19. The stationary type mixing apparatus comprises a cylindrical body a and cylindrical flow guide unit bodies b and c which are respectively axially concentrically inserted in the cylindrical body a in which the flow guide unit body b is layered on the flow guide unit body c. The flow guide unit bodies b and c have a plurality of polygonal perforations d each having a shape of mesh and are arranged in perpendicular to the axes of the flow guide unit bodies b and c. The perforations d of the flow guide unit bodies b and c are alternately arranged face to face to the perforations d of the other flow guide unit bodies b and c so as to communicate with one another.

In this stationary type mixing apparatus 1, fluids which entered from an inlet e strike perpendicularly against a side wall f forming the perforations d of an outside flow guide unit body b and are changed in their flowing directions, then they enter the perforations d of an inner side flow guide unit body c. Then, the fluids strike perpendicularly against a surface of an axial body g penetrating the center of the flow guide unit body c and are changed in their flowing directions, then further strike perpendicularly against the side wall f forming the perforations d of the flow guide unit body c and are changed in their flowing direction, and successively they pass through the perforations d which communicate with one another, and they are finally discharged from an outlet h.

Since the fluids strike perpendicularly against each side wall f, there is such a drawback that fluids having high flowing resistance and high viscosity are not discharged finally from the outlet h or a pump serving as a supply source for discharging the fluids from the outlet h must be made large.

Further, there are the following drawbacks. Since an upper end surface i of the side wall f forming the perforations d is formed in fiat surface shape, and a cornered portion k which is a crossing portion with a side surface j is formed at right angles, a high shearing force is applied to the fluids when the fluids pass through the cornered portion k, and imparts a destructive force, owing to the perpendicular striking of the fluids against the upper end surface i and the side wall f, is large so that bonding of the inner structure such as starch, protein, gluten, cellulose, fibers is D destroyed in case that the fluids are made from high polymer material. For example, gluten of some noodle to be processed by hand is changed to fibers and is oriented in a shape of the noodle depending on a processing method, dough of the noodle is mixed by the stationary type mixing apparatus, gluten appears like tiles and pebbles so that fiber property and orienting property are lost due to the aforementioned causes.

Further, there is such a drawback that the stationary type mixing apparatus is formed cylindrically, and a cross-sectional area of a flowing passage extending from the inlet e to the outlet h is the same, so that an inner pressure inside the stationary type mixing apparatus becomes the same, and the internal stress on the fluids is increased in the mixing process. Accordingly, if the dough of the noodle is processed by this stationary type mixing apparatus and it is rolled in this state, structure of gluten is further destroyed so that rolling of the dough cannot be continued.

SUMMARY OF THE INVENTION

It is an object of the invention to provide a stationary type mixing apparatus which can assure smooth flowing of fluids by permitting fluids not to strike perpendicularly against the side walls forming small chambers so as to reduce flowing resistance of fluids, further assure the mixture of fluids having high viscosity and also assure reduction of destruction of the inner structure of fluids. Further, the stationary type mixing apparatus can improve orientation of the inner structure by varying an inner pressure thereof, and also improve mixing efficiency of plural kinds of raw materials by permitting fluids to be subjected to dispersion, joining, meandering and turning.

In view of aforementioned drawbacks such as loss of fiber property and orienting property of the inner structures of fluids in case of fluids having high viscosity, and destruction of the inner structure caused by the increase of internal stress at the mixing time, it is an object of the present invention to provide a stationary type mixing apparatus having small chambers which are arranged alternately face to face so as to communicate with other plurality of small chambers in a flowing space formed by an outer cylindrical unit body and an inner cylindrical unit body, wherein fluids are subjected to a complex mixing operation caused by a slant striking, dispersion, meandering, turning, joining, change of pressure, etc.

The stationary type mixing apparatus comprises double fluid unit bodies, each of the double fluid unit bodies composed of a frustoconical outer cylindrical unit body having a large diameter, the body including a frustoconical outer cylindrical body, a frustoconial inner cylindrical unit body having a diameter being smaller than that of the outer cylindrical unit body, the boby including a frustoconical inner cylindrical body, wherein the inner cylindrical unit body is inserted concentrically in an inner space of the outer cylindrical unit body so as to form a passage space between the outer cylindrical unit body and the inner cylindrical unit body.

Large diameter opened ends or small diameter opened ends of the double fluid unit bodies are coupled to each other, or large diameter opened end of one of the double fluid unit bodies are coupled to small diameter opened end of the other of the double fluid unit bodies, and a plurality of small chambers are arranged on an inner peripheral surface of the outer cylindrical body and opened at fronts thereof, wherein width of each side wall forming each small chamber is decreased toward an upper direction thereof, a plurality of small chambers arranged on an outer peripheral surface of the inner cylindrical body and opened at fronts thereof, wherein width of each side wall forming each small is decreased toward an upper direction thereof, and small chambers of the inner cylindrical unit body and the small chambers of the outer cylindrical unit body are arranged alternately face to face so as to communicate with one another in a state where the inner cylindrical unit body is concentrically inserted into the inner space of the outer cylindrical unit body.

PREFERRED EMBODIMENT OF THE INVENTION

Figure 1:
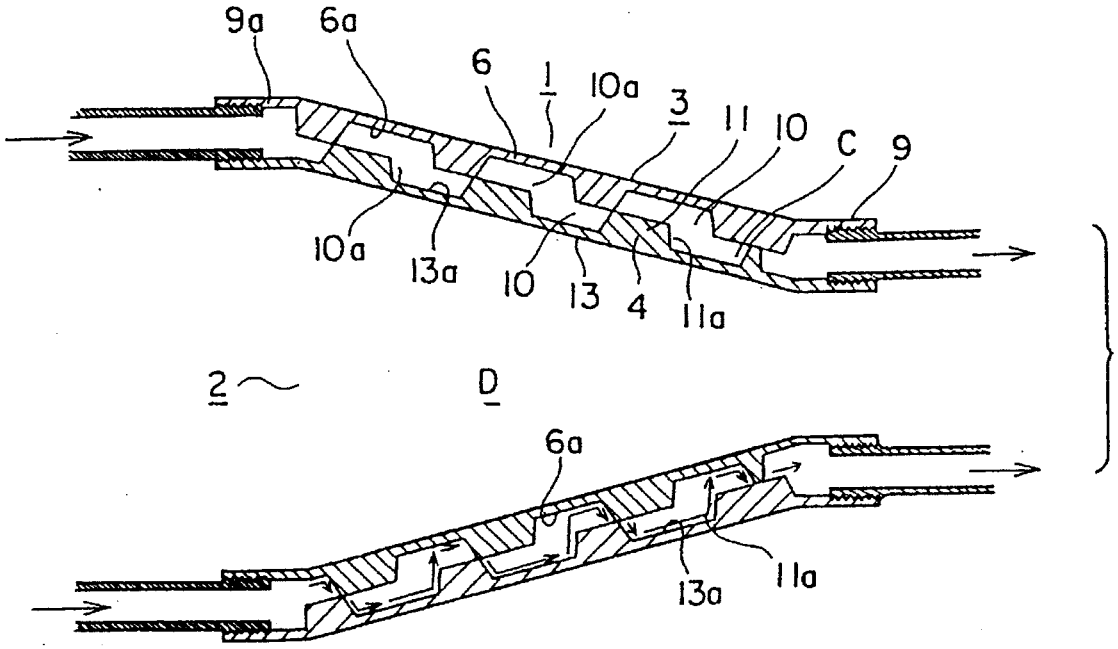
FIG. 1 is a schematic cross-sectional view of a stationary type mixing apparatus comprising a single fluid unit body according to a first embodiment of the invention.

An embodiment of the present invention will be now described with reference to attached drawings.

A stationary type mixing apparatus 1 of fluids comprises a single fluid unit body 2 or double fluid unit bodies 2 and 2*a*. Each of the double fluid bodies 2 and 2*a* comprises a frustoconical outer cylindrical unit body 3 (hereinafter referred to as an outer cylindrical unit body 3) having a large diameter and an inner cylindrical unit body 4 diameter of which is smaller than that of the outer cylindrical unit body 3 (hereinafter referred to as an inner cylindrical unit body 4). The inner cylindrical unit body 4 is mounted concentrically in the outer cylindrical unit body 3, and a passage space C through which fluids to be mixed with one another are formed between the outer cylindrical unit body 3 and the inner cylindrical unit body 4. The double fluid unit bodies 2 and 2*a* have inlets and outlets at large diameter opened ends or small diameter opened ends thereof.

Figure 2:
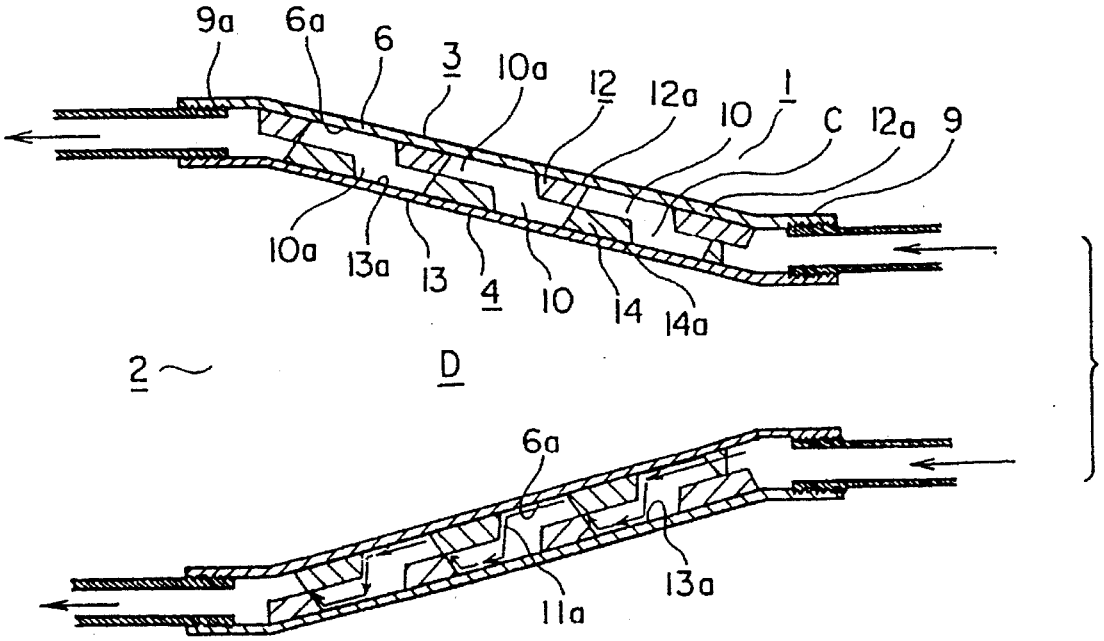
FIG. 2 is a schematic cross-sectional view of a stationary type mixing apparatus comprising a single fluid unit body according to a modification of the first embodiment of the invention.
Figure 3:
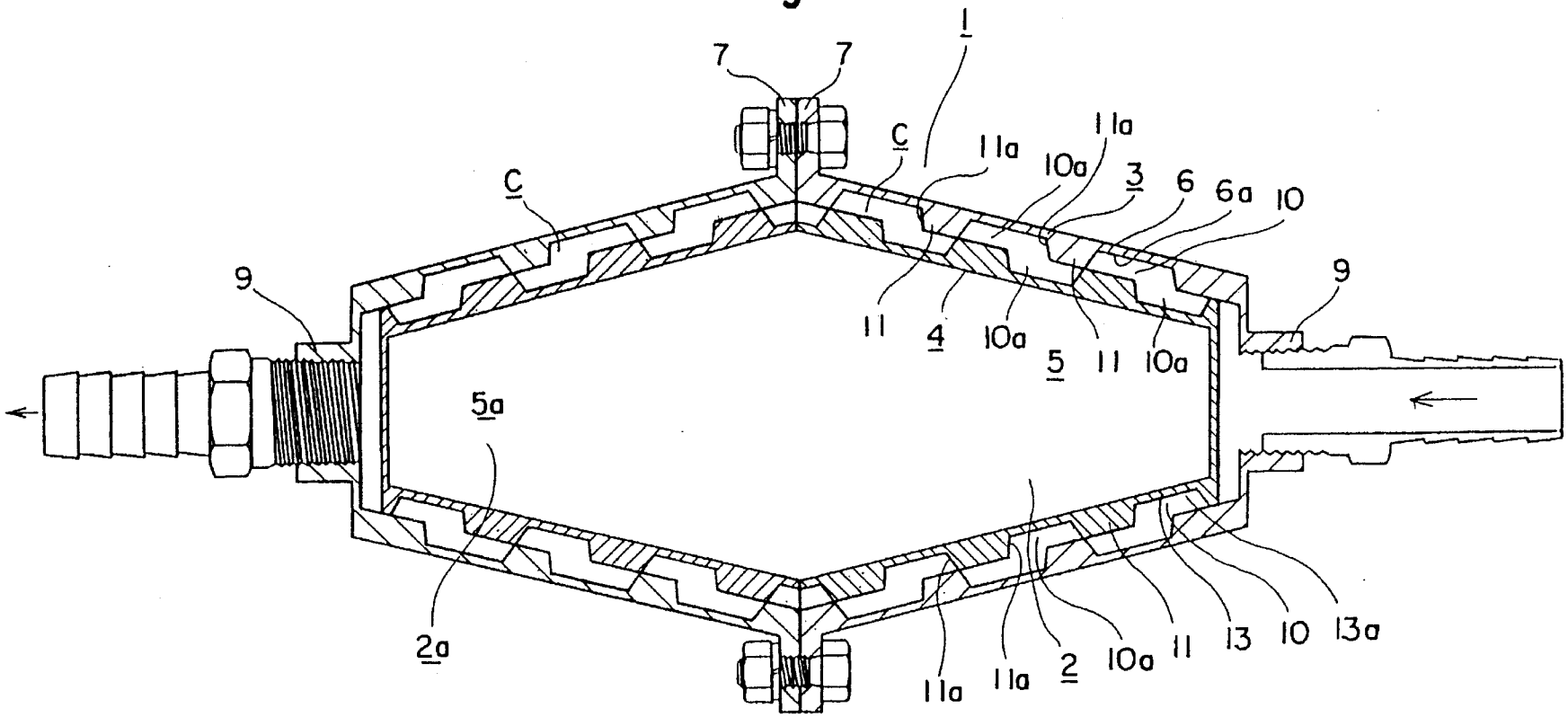
FIG. 3 is a schematic cross-sectional view of a stationary type mixing apparatus comprising double fluid unit bodies according to a second embodiment of the invention.
Figure 4:
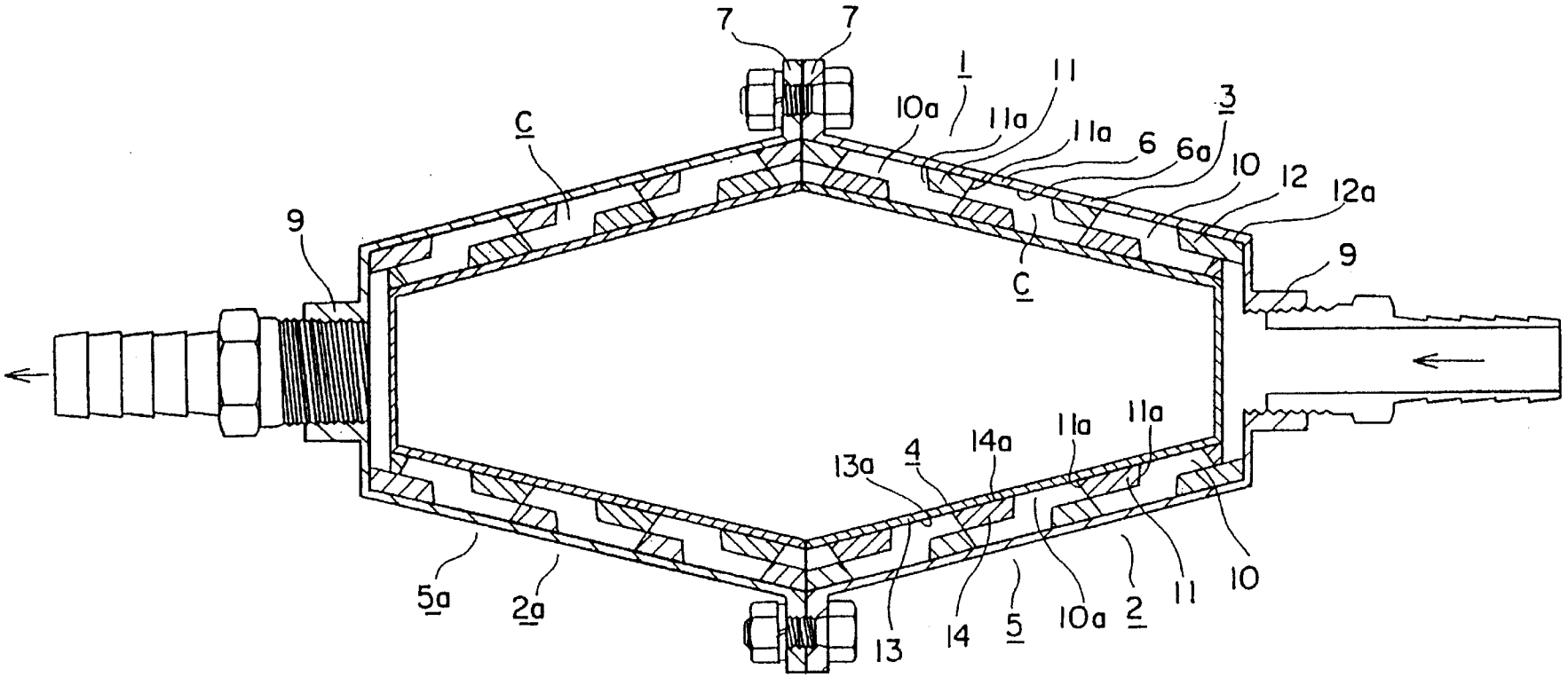
FIG. 4 is a schematic cross-sectional view of a stationary type mixing apparatus comprising double fluid unit bodies according to a first modification of the second embodiment of the invention.
Figure 5:
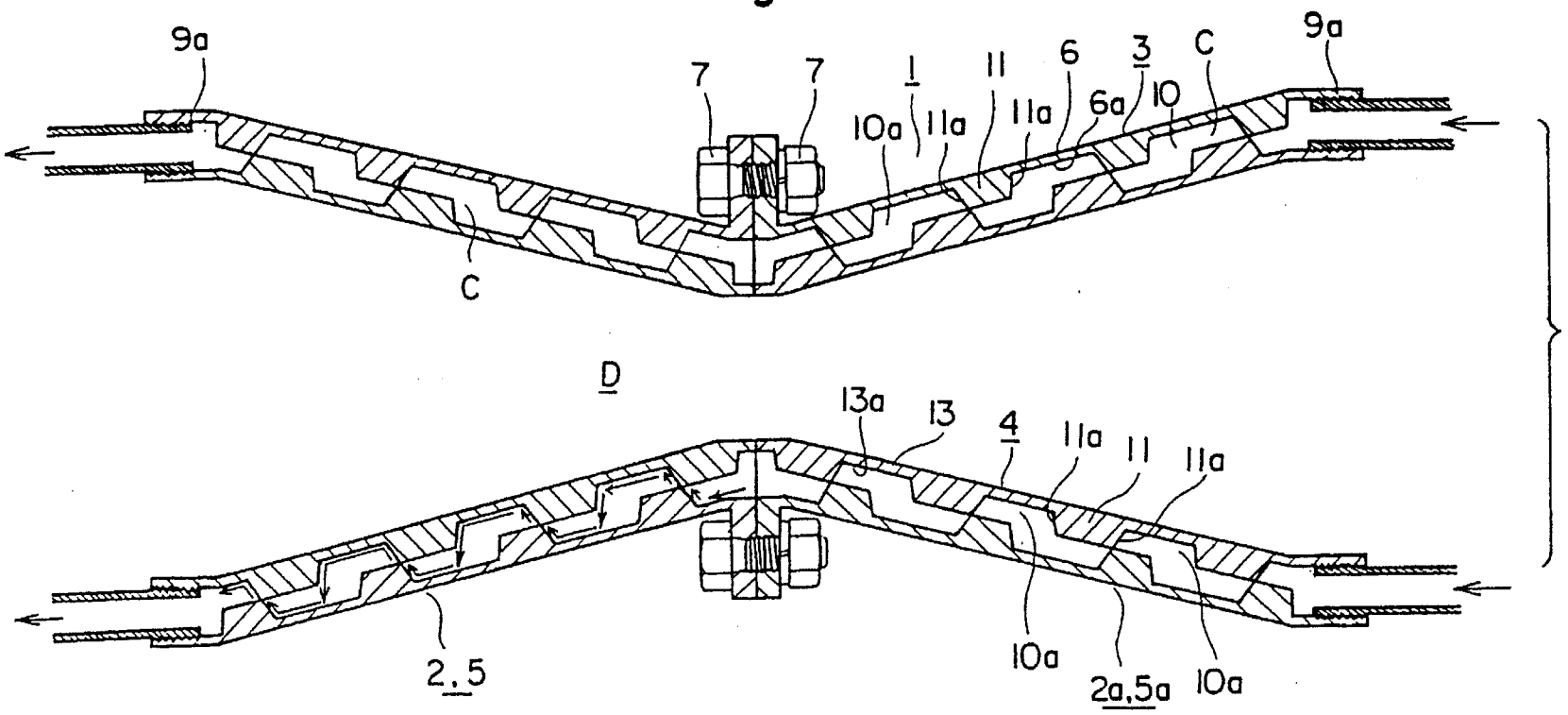
FIG. 5 is a schematic cross-sectional view of a stationary type mixing apparatus comprising double fluid unit bodies according to a second modification of the second embodiment of the invention.

The stationary type mixing apparatus 1 comprising the single fluid unit body 2 has the inlet and outlet in either large diameter opened end or small diameter opened end as shown in FIGS. 1 and 2. In the stationary type mixing apparatus 1 comprising the double fluid unit bodies 2 and 2*a*, the large or small diameter opened ends thereof are coupled to each other, wherein the fluid unit body 2 having an inlet at the small side is called as a diffusion element 5 and the fluid unit body 2*a* having an outlet at the small opened end is called as a collecting element 5*a* as shown in FIGS. 3, and 5. In the stationary type mixing apparatus 1 comprising the double fluid unit bodies 2 and 2*a* in FIG. 6, the large and small diameter opened ends thereof are coupled to each other, and either the large or small diameter opened end has the inlet.

Figure 7:
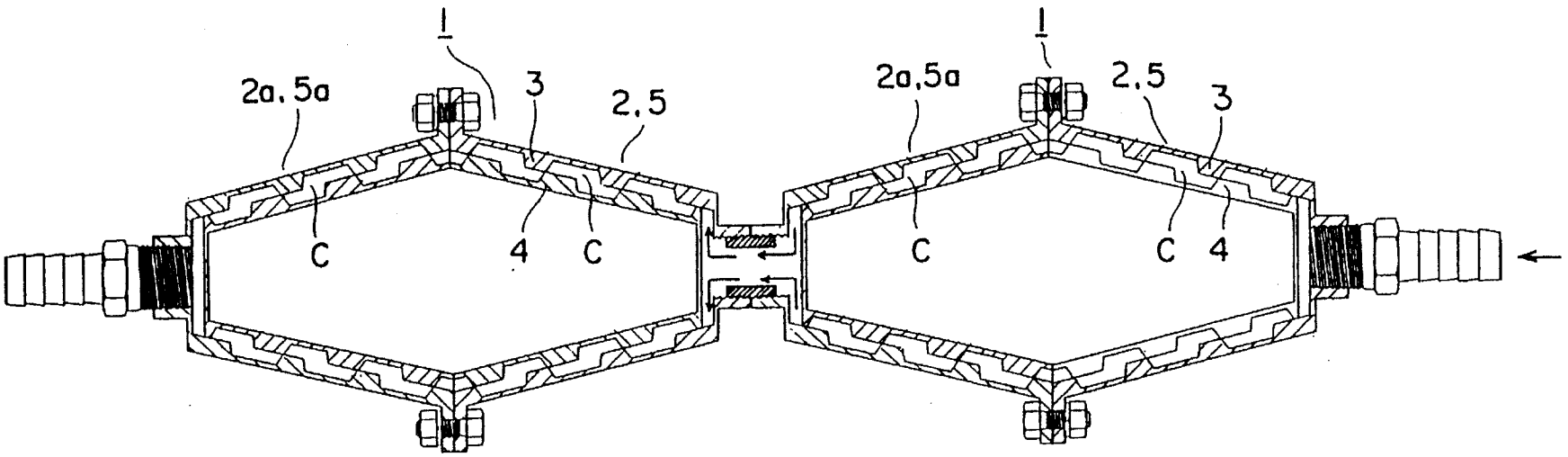
FIG. 7 is a schematic cross-sectional view of a stationary type mixing apparatus comprising double fluid unit bodies according to a fourth modification of the second embodiment of the invention, wherein two double fluid unit bodies are coupled.
Figure 8:
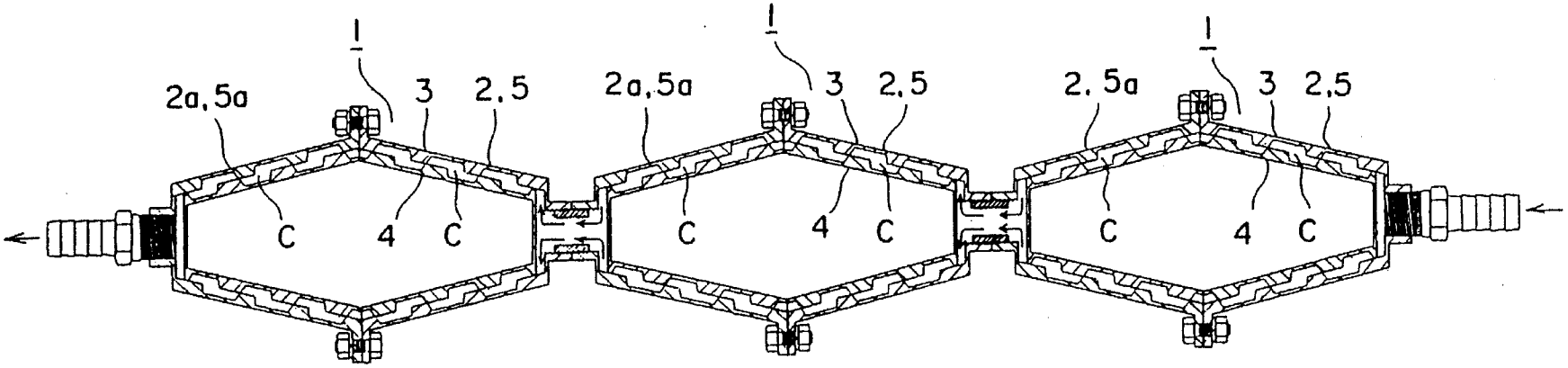
FIG. 8 is a schematic cross-sectional view of a stationary type mixing apparatus comprising double fluid unit bodies according to a fifth modification of the second embodiment of the invention, wherein three double fluid unit bodies are coupled.
Figure 9:
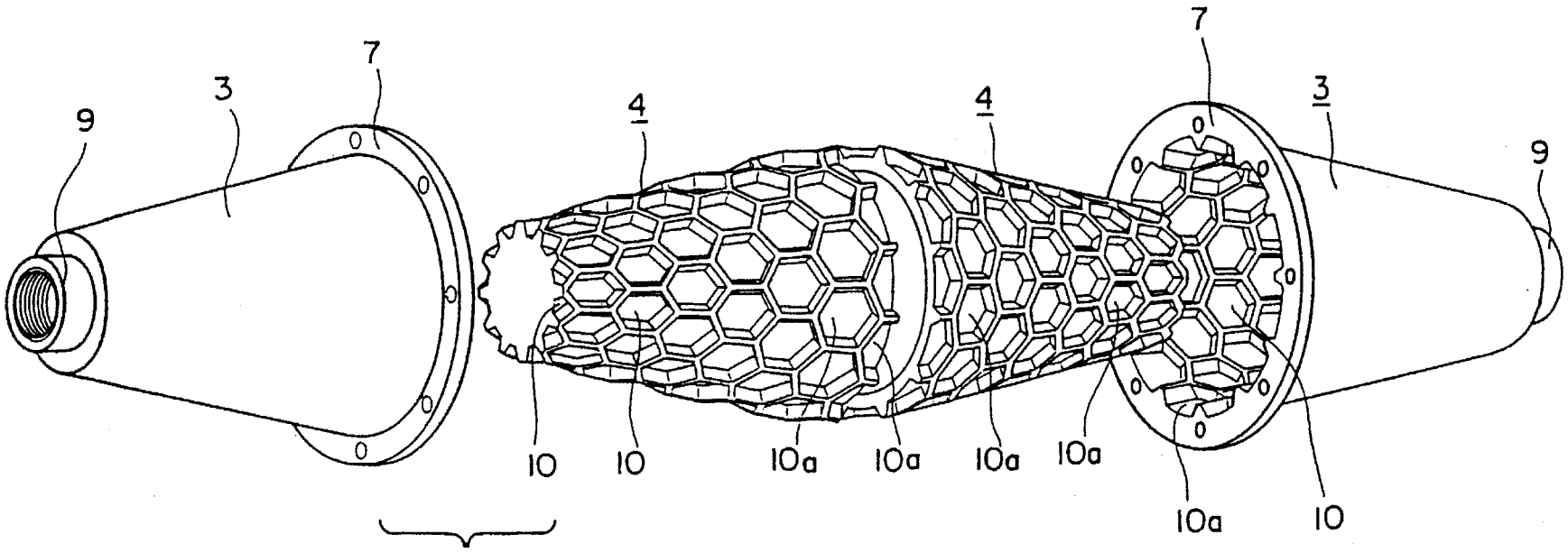
FIG. 9 is an exploded schematic perspective view of the stationary type mixing apparatus of the second embodiment.
Figure 10:
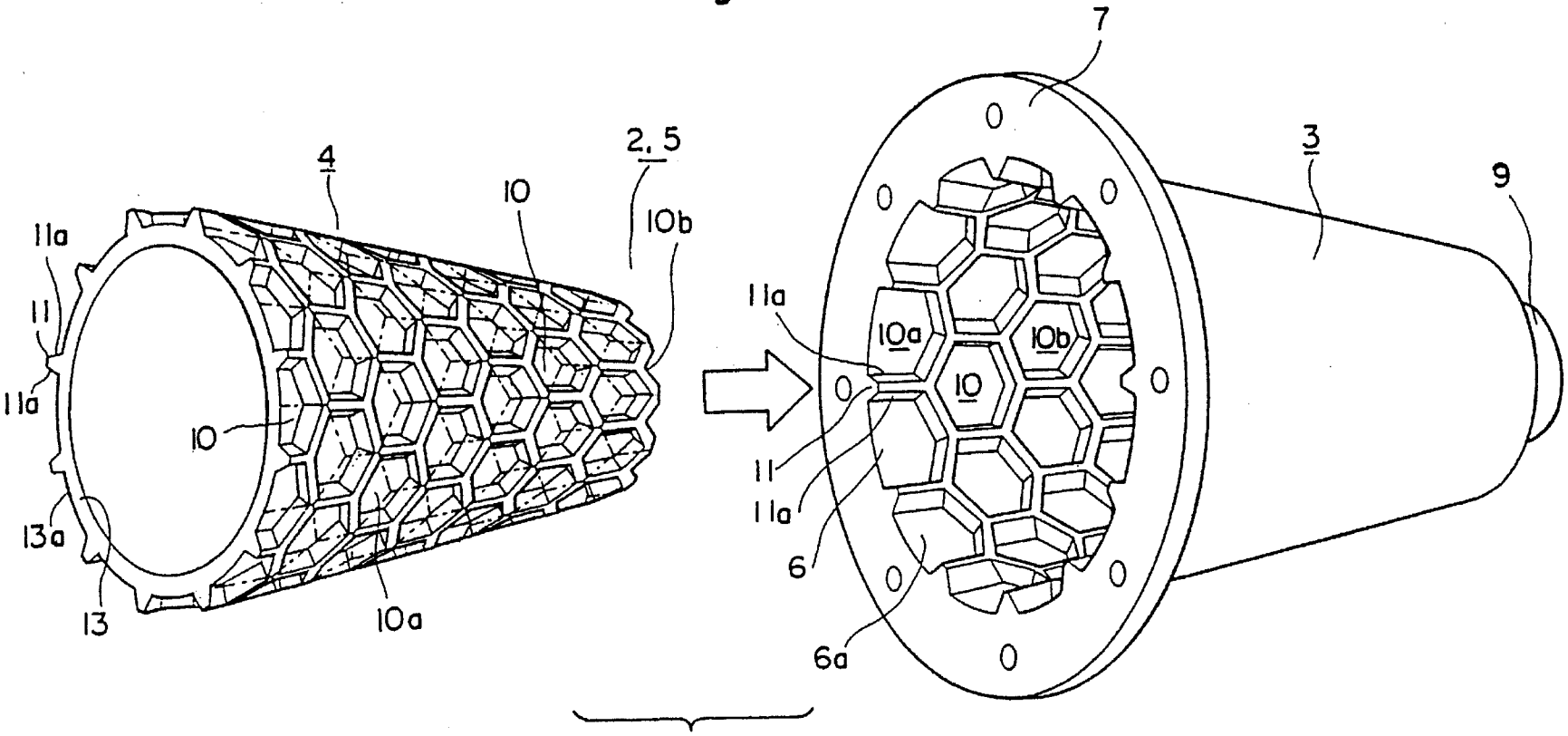
FIG. 10 is an exploded schematic perspective view of a diffusion element serving as the fluid unit body constituting the stationary type mixing apparatus of the second embodiment.
Figure 11:
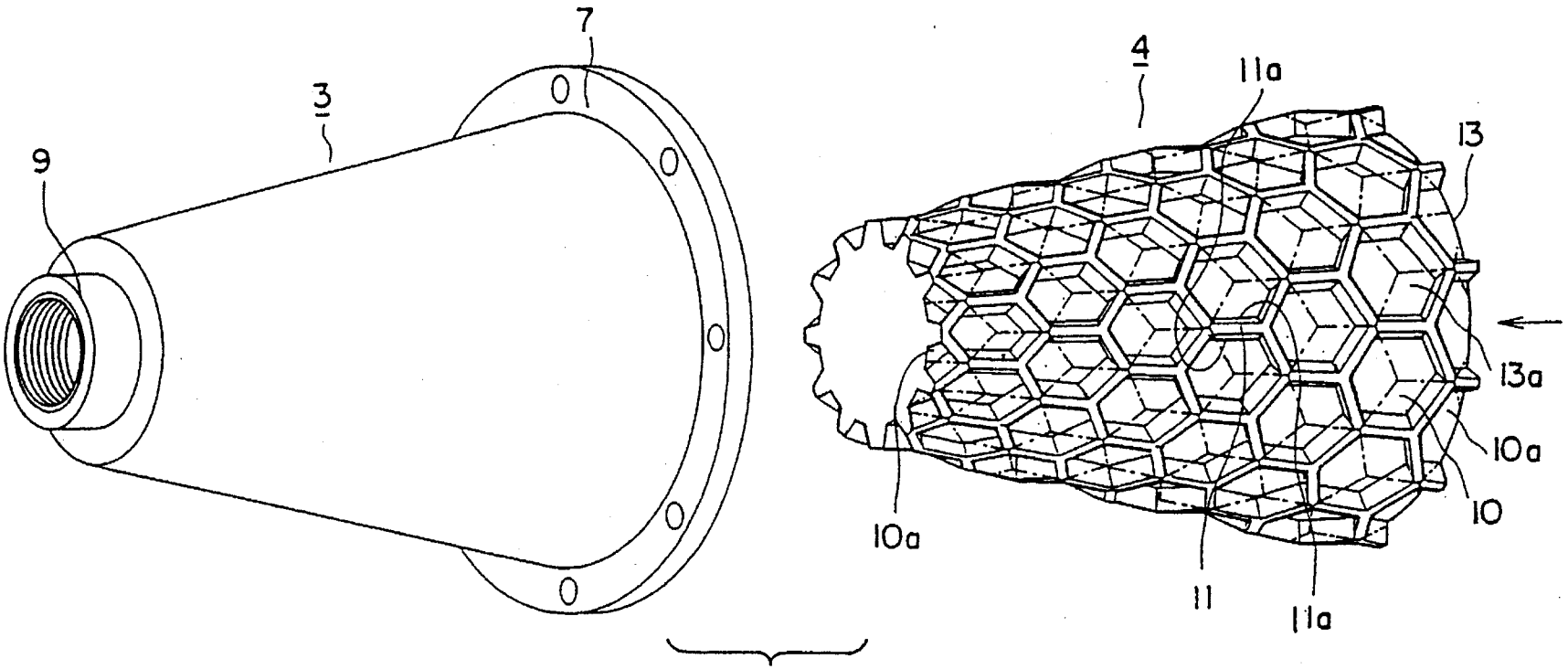
FIG. 11 is an exploded schematic perspective view of a collecting element serving as the fluid unit body constituting the stationary type mixing apparatus of the second embodiments.

It is possible to connect the stationary type mixing apparatus 1 to each other as shown in FIGS. 7 and 8 wherein each of the stationary type mixing apparatus 1 comprises the collecting element 5*a* and the diffusion element 5. It is a matter of course that the stationary type mixing apparatus 1 can be coupled to other stationary type mixing apparatus 1, namely, the number of stationary type mixing apparatus 1 to be coupled to each other can be increased. Further, ratio of tapering of the outer cylindrical unit body 3 relative to that of the inner cylindrical unit body 4 can be varied appropriately depending on kinds of fluids.

In the stationary type mixing apparatus 1 comprising the single fluid unit body 2, connecting opening portions 9 and 9*a*, on which a fluid supply pipe and a fluid discharge pipe are mounted, are formed respectively at the large and small opened ends thereof.

In the stationary type mixing apparatus 1 comprising the double fluid unit bodies 2 and 2*a*, flanges 7 protrude outwardly from the large diameter opened end of a frustoconical outer cylinder 6 of the outer cylindrical unit body 3, and the connecting opening portions of fluid supply pipes through which fluids are supplied protrude axially from a small diameter opened end of a frustoconical outer cylinder 6 of the outer cylindrical unit body 3. Alternately, flanges 7 protrude outwardly from the small diameter opened end of the outer cylinder 6, and the connecting opening portions 9*b* of the fluid supply pipes through which fluids are supplied protrude axially from the larger diameter opened end of the outer cylinder 6. In a word, the flanges 7 are provided at opened end portions at portions where the double fluid unit bodies 2 and 2*a* are coupled to each other, and the connecting opening portions 9 and 9*a* are provided at opened end portions where the double fluid unit bodies 2 and 2*a* are not coupled to each other.

Figure 6:
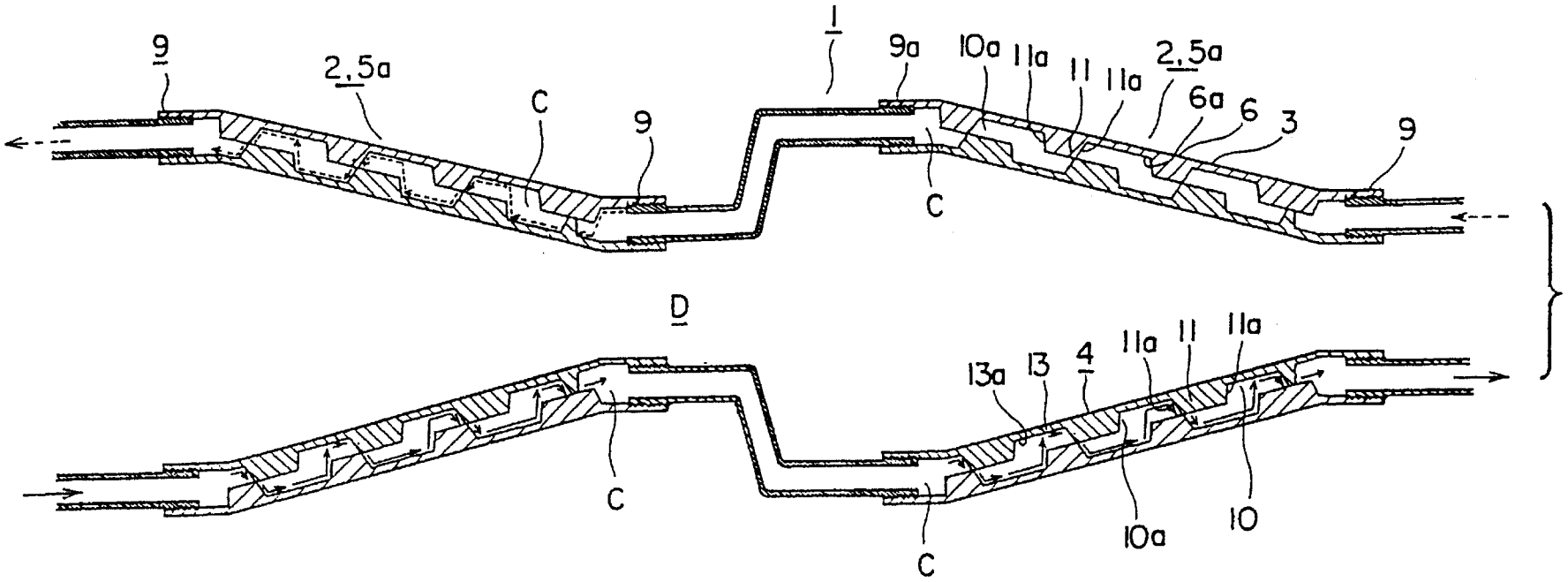
FIG. 6 is a schematic cross-sectional view of a stationary type mixing apparatus comprising double fluid unit bodies according to a third modification of the second embodiment of the invention.

In case of the stationary type mixing apparatus 1 as shown in FIG. 6, the connecting opening portions 9 and 9*a* may be coupled to each other by an appropriate connecting pipe.

Polygonal small chambers 10, 10*a* . . . which are opened at fronts thereof and provided on the inner peripheral surface 6*a* of the outer cylindrical body 6 are arranged in circumferential and axial directions, and they are increased in their capacities as they approach to the large diameter opened end of the outer cylindrical body 6.

Figure 12:
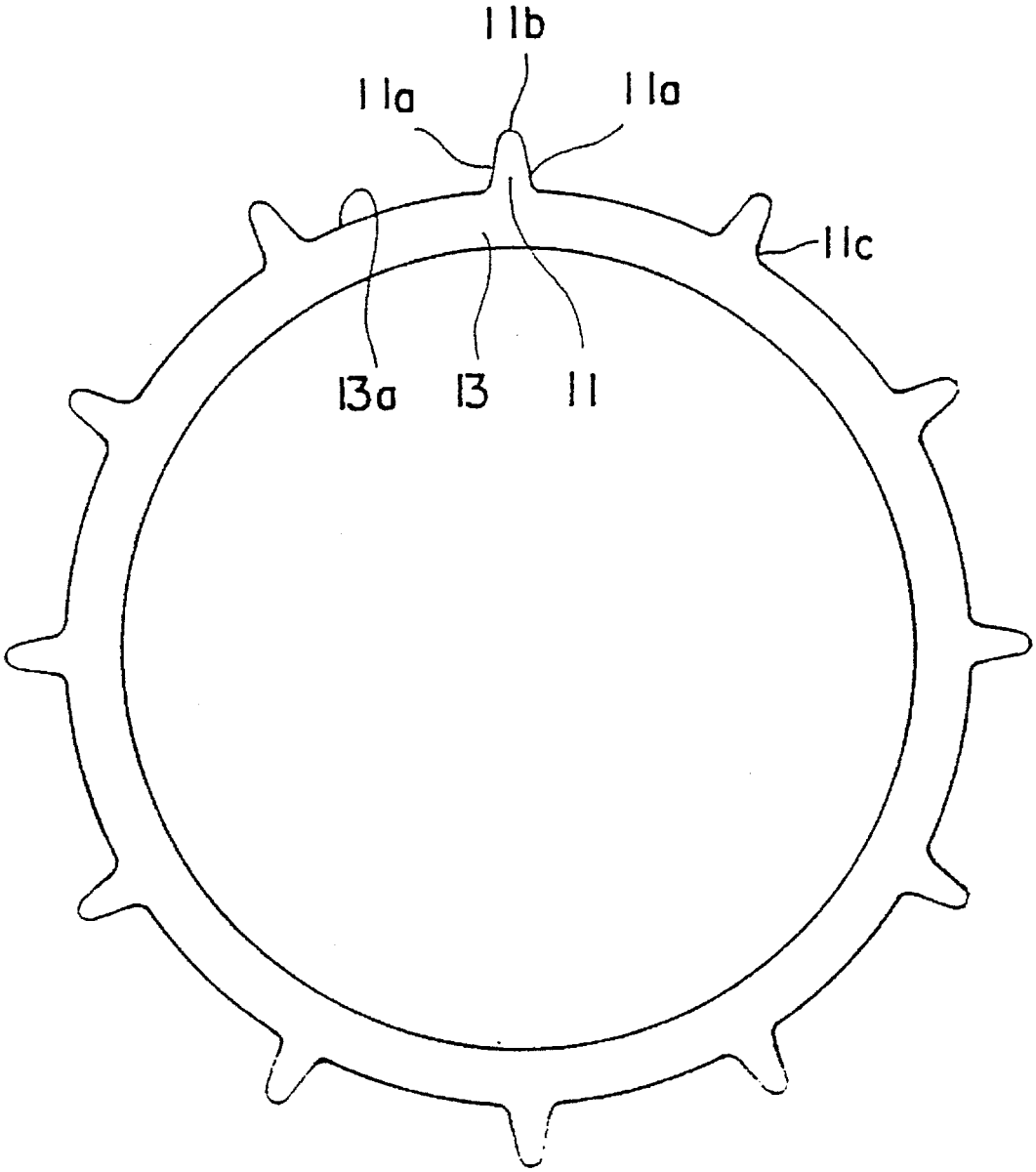
FIG. 12 is a view as viewed from the arrow denoted in FIG. 11.
Figure 13:
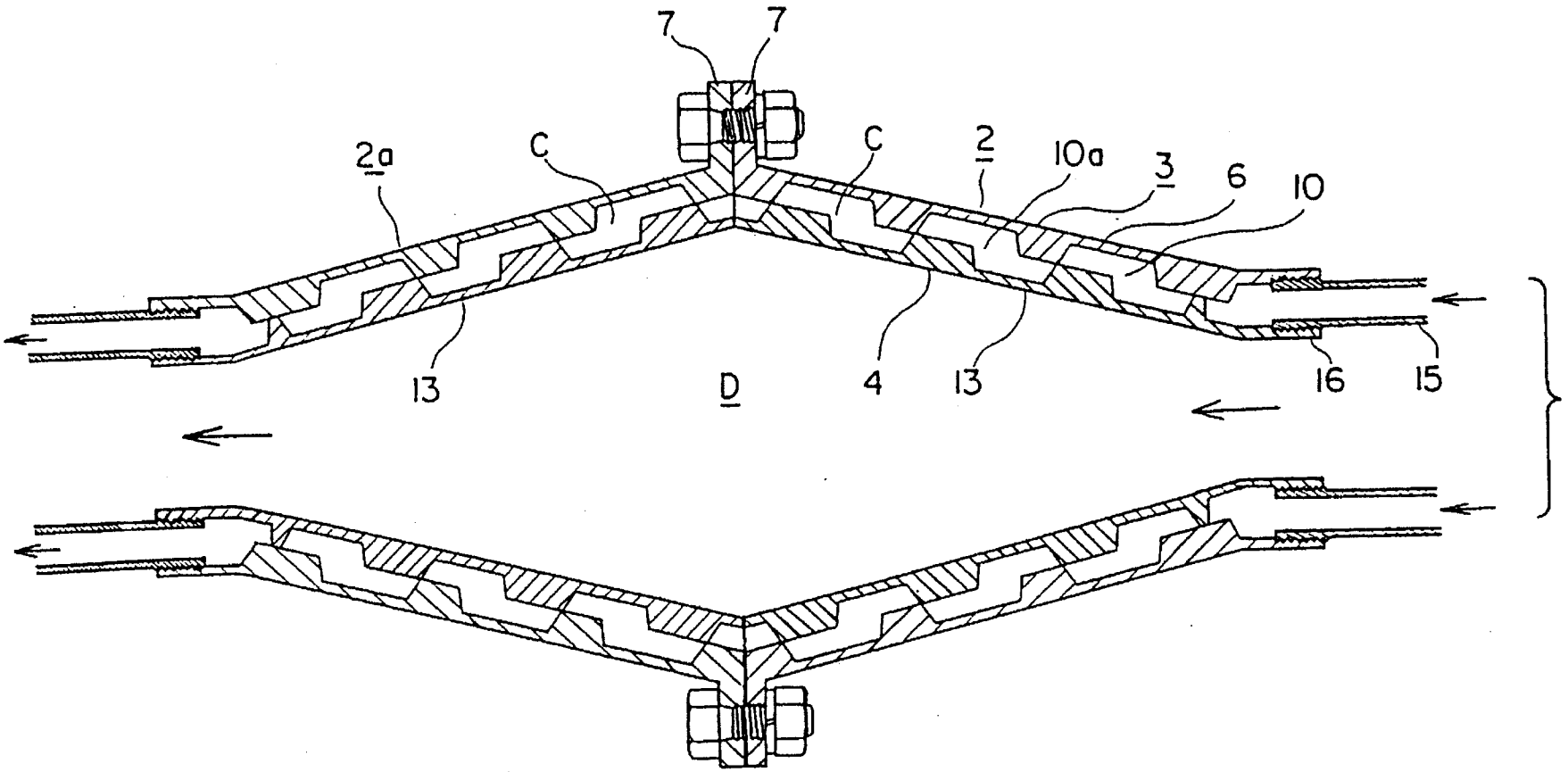
FIG. 13 is a schematic cross-sectional view of a stationary type mixing apparatus comprising double fluid unit bodies according to a sixth modification of the second embodiment of the invention, wherein two double fluid unit bodies are coupled.
Figure 14:
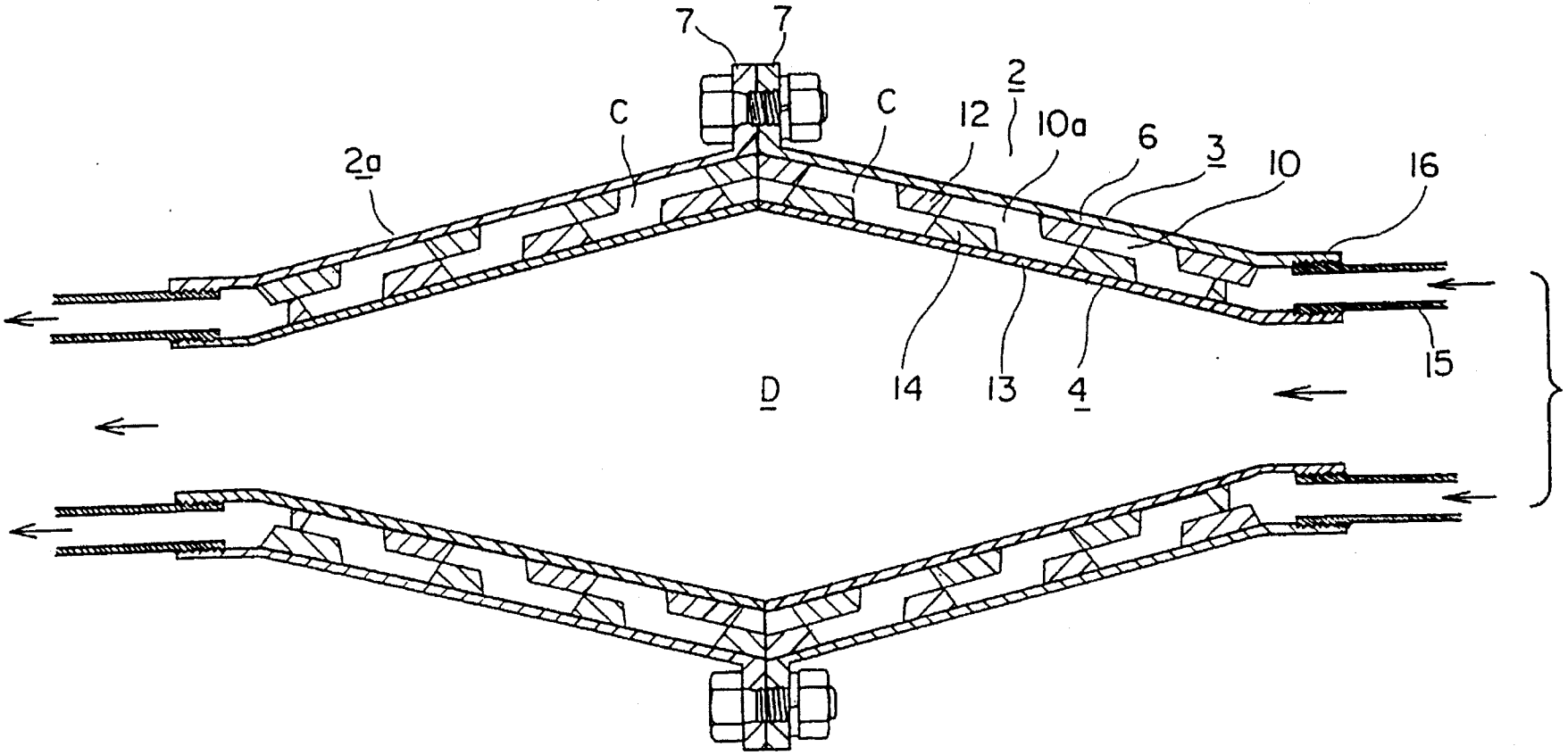
FIG. 14 is a schematic cross-sectional view of a stationary type mixing apparatus comprising double fluid unit bodies according to a seventh modification of the second embodiment of the invention, wherein two double fluid unit bodies are coupled.

Continuous side walls 11 for forming the small chambers 10, 10*a* . . . are formed in a manner that each of the side walls 11 is gradually narrow in an upward direction toward the front thereof so as to be tapered at its side surfaces, and the small chambers 10, 10*a* . . . are increased in their diameters toward the fronts. Further, as shown in FIG. 12, an upper end surface 11*b* of the side wall 11 is radiused, and each connecting portion 11*c* between the inner peripheral surface 6*a* of the outer cylindrical body 6 and a base of the side wall 11 forming the small chambers 10, 10*a* . . . are thickened toward the base and reversely radiused, i.e. concave-shaped and each crossing portion 11*d* of each side wall 11 for forming the small chambers 10, 10*a* . . . are thickened and reversely radiused, and thickened in case that it has an acute angle such as a triangular or square shape.

Figure 15:
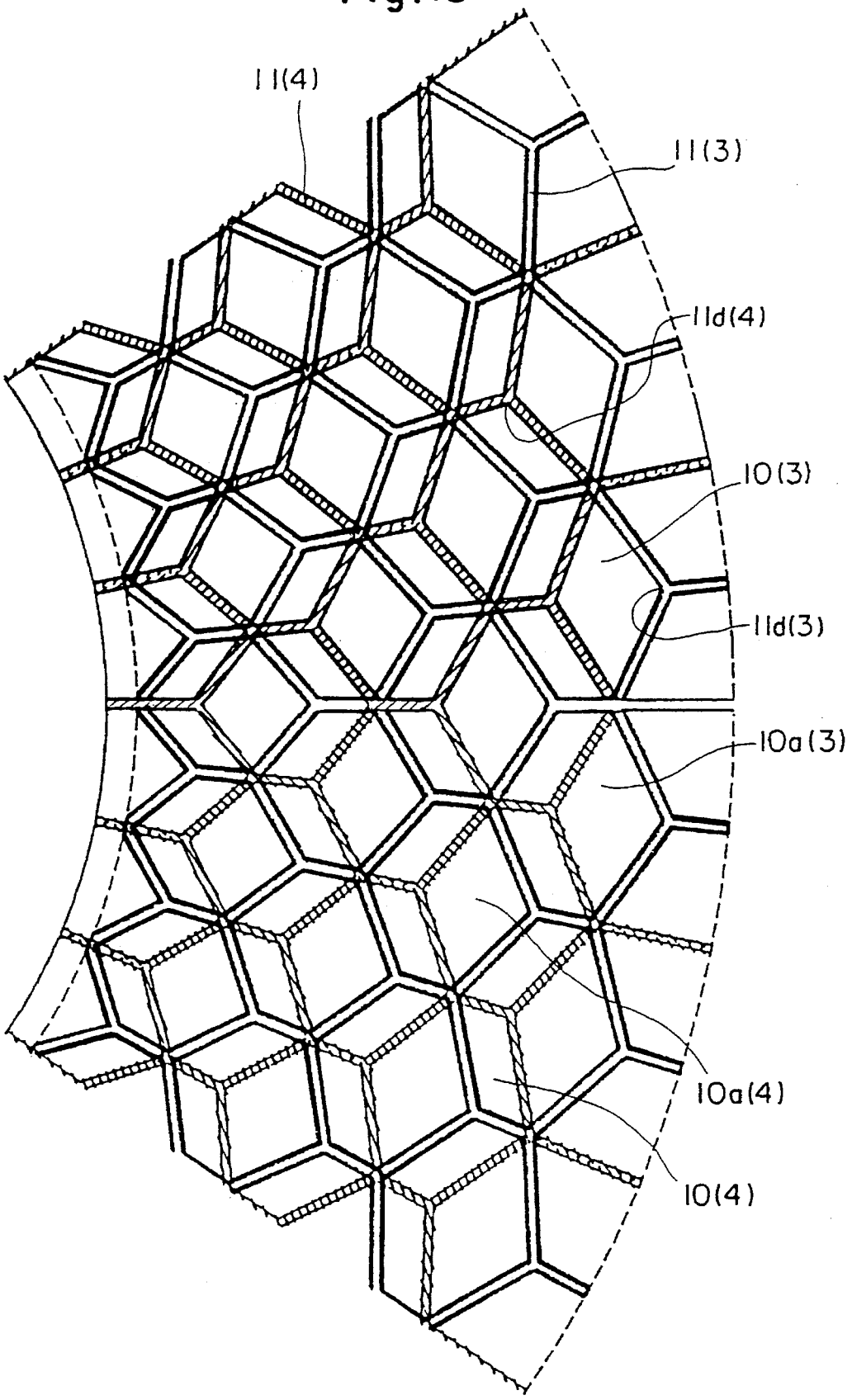
FIG. 15 is a developing view showing relation between small chambers each having a hexagonal shape provided in the stationary type mixing apparatus of the first and second embodiments of the present invention.
Figure 16:
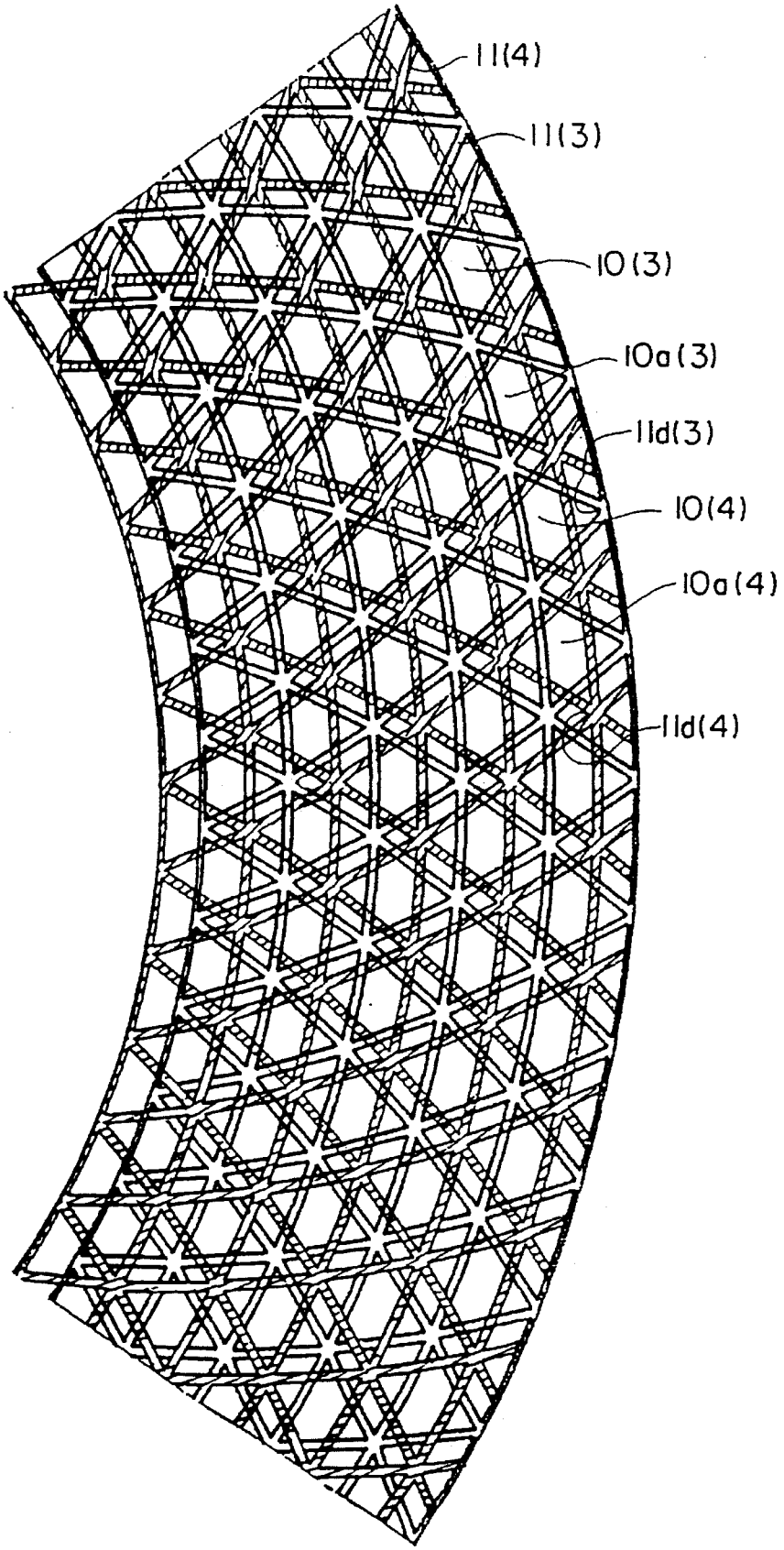
FIG. 16 is a developing view showing relation between small chambers each having a triangular shape provided in the stationary type mixing apparatus of the first and second embodiments of the present invention.
Figure 17:
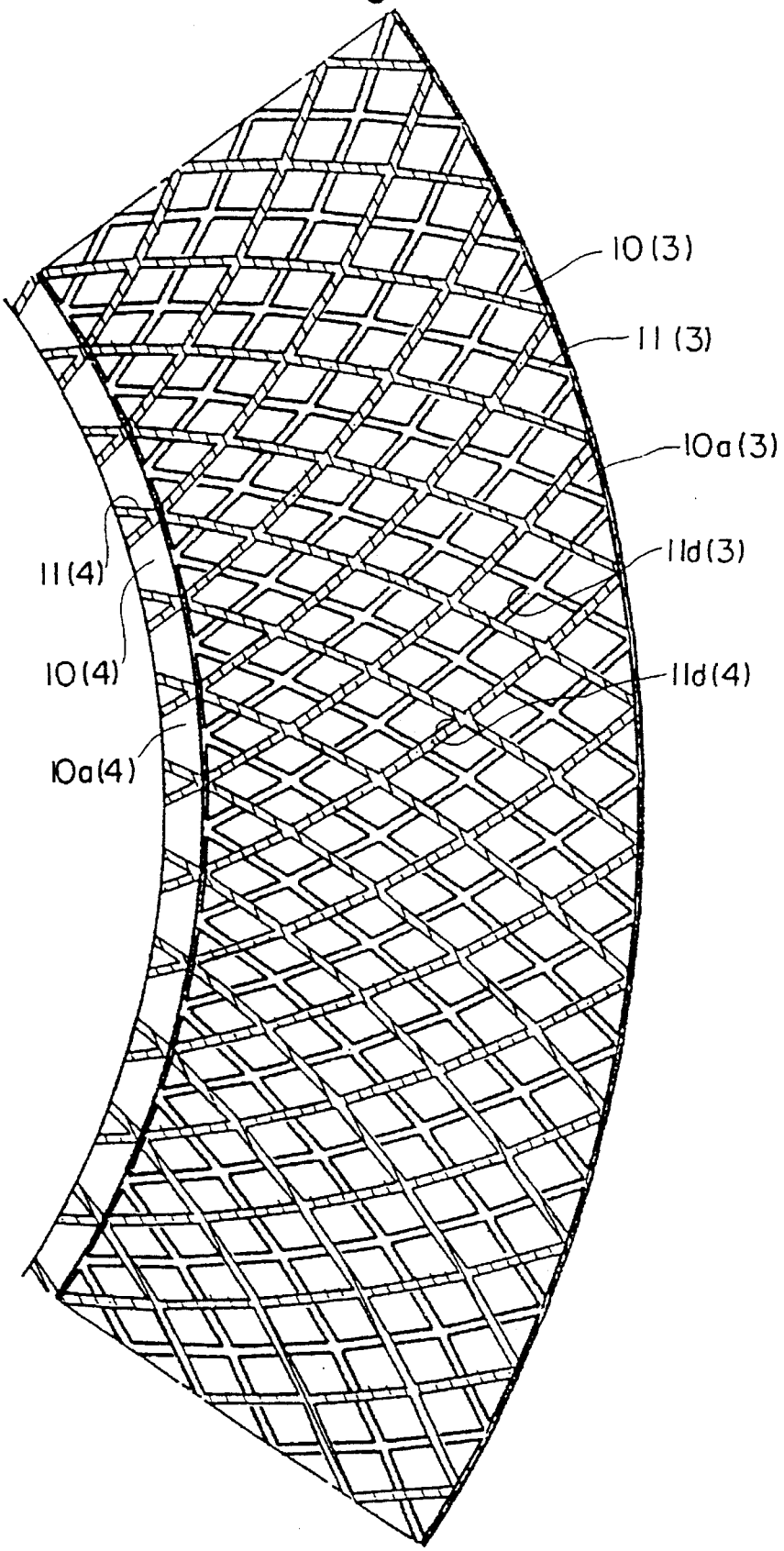
FIG. 17 is a developing view showing relation between small chambers each having a square shape provided in the stationary type mixing apparatus of the first and second embodiments of the present invention.
Figure 18:
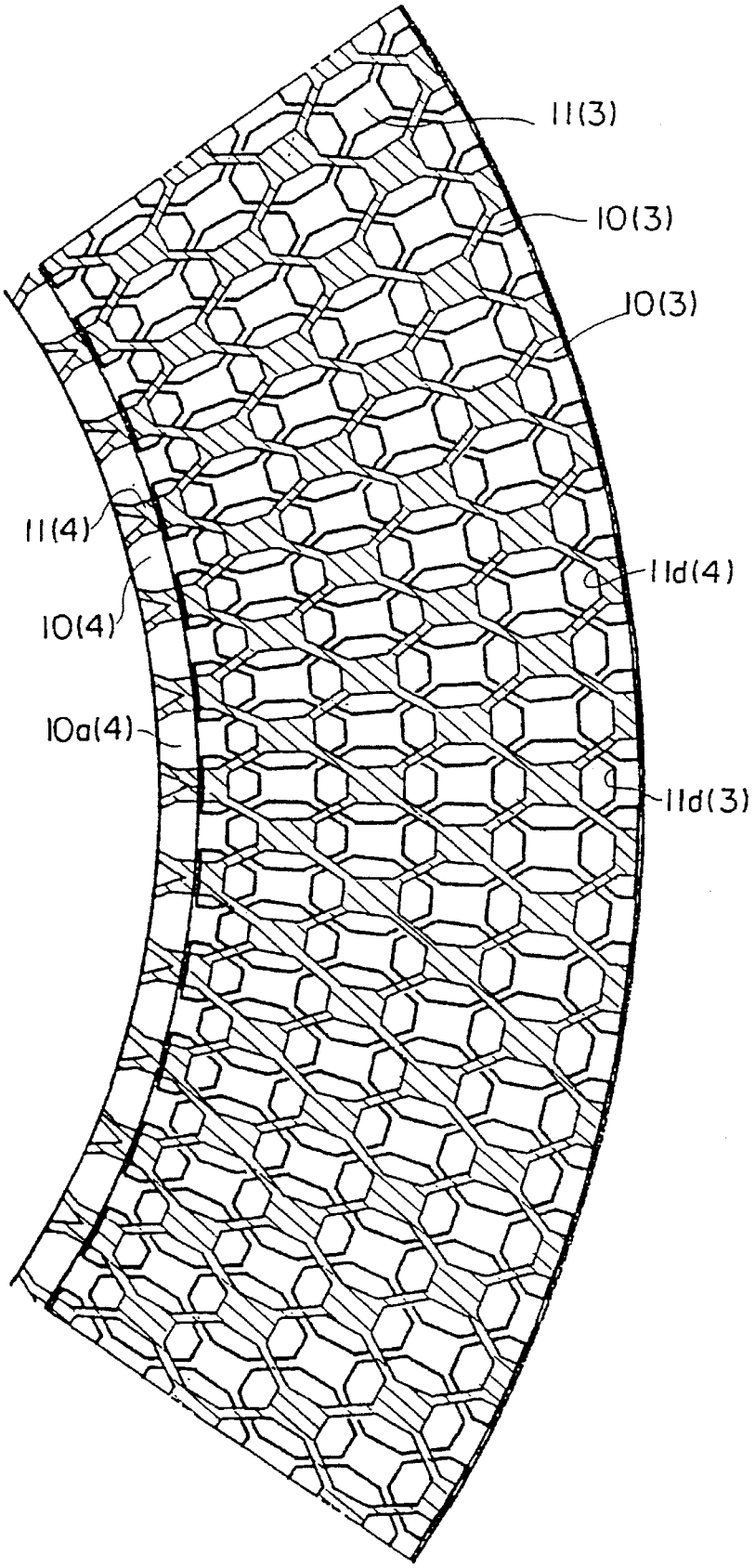
FIG. 18 is a developing view showing relation between small chambers each having an octagonal shape provided in the stationary type mixing apparatus of the first and second embodiments of the present invention.
Figure 19:
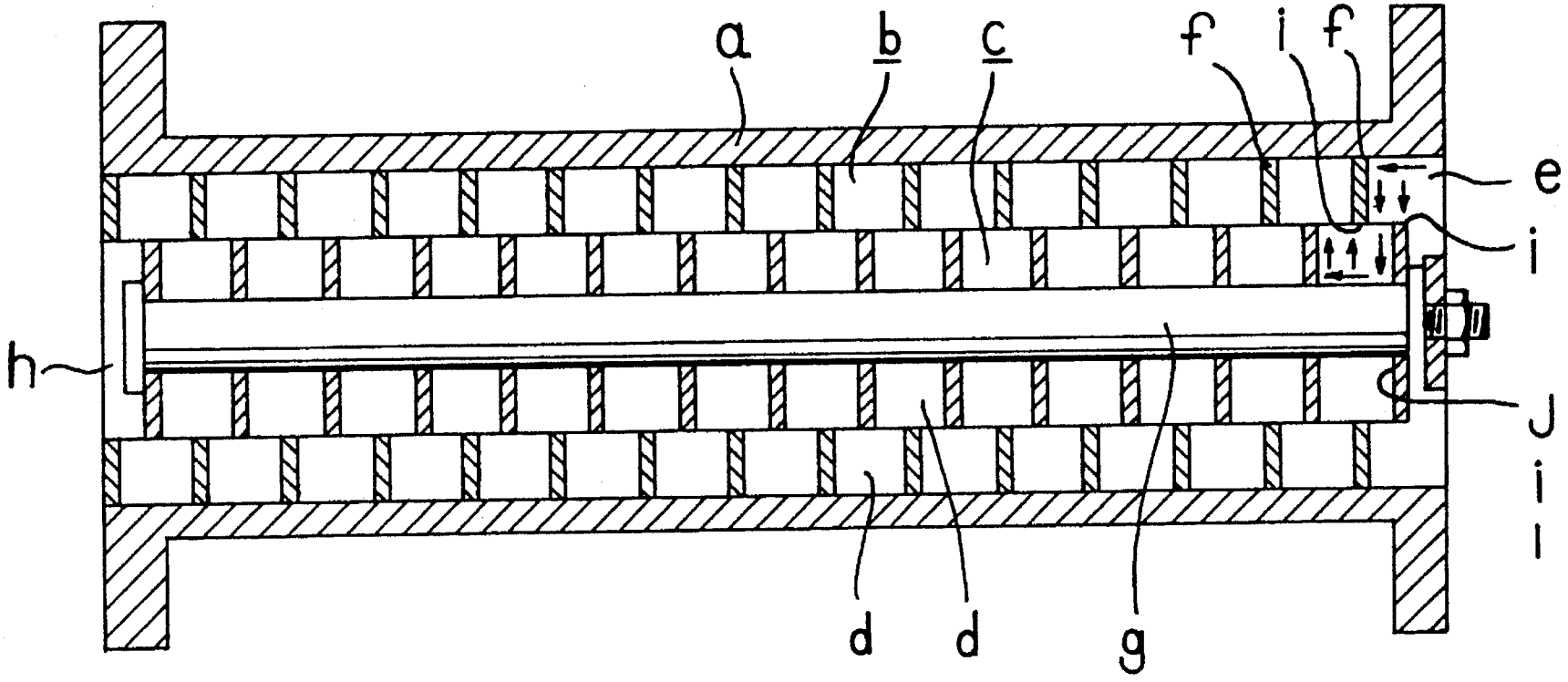
Fig. 19 PRIOR ART
FIG. 19 is a cross-sectional view of a prior art stationary type mixing apparatus.

As shown in FIG. 15, etc., the small chambers 10, 10*a* . . . which are also opened in an axial direction by a part of the side wall 11 forming the small chambers 10, 10*a* . . . which are arranged in a circumferential direction at both end inner sides.

In the embodiment of the outer cylindrical unit body 3, the small chambers 10, 10*a* . . . are formed by the side walls 11 which are integrally projecting from the inner peripheral surface 6*a* of the outer cylinder 6, but they are not limited to such a structure. For example, small chamber structuring network body 12 is separately formed by only the continuous side walls 11 forming the small chambers 10, 10*a* . . . so as to easily manufacture the outer cylindrical unit body 3 by simplifying the structure of the mold, etc., wherein the small chamber structuring network body 12 are concentrically inserted into the inner space of the outer cylinder 6 and an outer peripheral surfaces of the small chamber structuring network body 12 are brought into contact with the inner peripheral surface 6*a* of the outer cylinder 6, thereby forming the outer cylindrical unit body 3.

The inner cylindrical unit body 4 may be formed in frustoconical and it closes a small diameter opened end of an inner cylindrical body 13, which is smaller than the outer cylindrical unit body 3 in diameter thereof. A plurality of polygonal small chambers 10, 10*a* . . . , which are opened at fronts thereof are arranged on an outer peripheral surface 13*a* of the inner cylindrical body 13 like the single fluid unit body 2, in a circumferential direction and an axial direction thereof, while the side walls 11 forming the small chambers 10, 10*a* . . . are reduced in their widths in an upward direction toward the front thereof, and side surfaces 11*a* of the walls 11 are tapered, and the small chambers 10, 10*a* . . . are increased in their diameters toward the front thereof.

As shown in FIG. 12, the upper end surface 11*b* of the side wall 11 is radiused and the connecting portion 11*c* between the outer peripheral surface 13*a* of the inner cylindrical body 13 and a base of the side wall 11 forming the small chambers 10, 10*a* . . . is thickened and radiused, and a crossing portion 11*d* of each side wall 11 for forming the small chambers 10, 10*a* . . . is thickened and reversely radiused in case that it has an acute angle such as a triangular or square shape.

As shown in FIG. 15, etc., there are formed the small chambers 10, 10*a* . . . which are opened in the axial direction by a part of the side wall 11 forming the small chambers 10, 10*a* . . . which are arranged in the circumferential direction at inner both ends of the inner cylindrical unit body 4.

In the inner cylindrical unit body 4 of the above embodiment, each of the small chambers 10, 10*a* . . . are formed by the side wall 11 integrally projecting from the outer peripheral surface 13*a* of the inner cylindrical body 13, but they are not limited to such a structure. For example, small chamber structuring network body 14 are individually formed by only the continuous side walls 11 forming the small chambers 10, 10*a* . . . so as to be easily manufactured by simplifying the structure of the mold, etc., wherein the small chamber structuring network body 14 is concentrically inserted on to the outer peripheral surface 13*a* of the inner cylindrical body 13, and an inner peripheral surface 14*a* of the small chamber structuring network body 14 is brought into contact with the outer peripheral surface 13*a* of the inner cylinder 13, thereby forming the inner cylindrical unit body 4.

In a state where the inner cylindrical unit body 4 is concentrically inserted into the inner space of the outer cylindrical unit body 3 so as to form the double fluid unit bodies 2 and 2*a*, the small chambers 10, 10*a* . . . of inner cylindrical unit body 4 and the small chambers 10, 10*a* . . . of the outer cylindrical unit body 3 are alternately arranged face to face so as to communicate with one another.

In the aforementioned embodiment, the small chambers 10, 10*a* . . . are formed hexagonal and arranged like a honeycomb but they are not limited to such a shape, for example, they may be triangular, square, octagonal, etc. The number of arrangement of the small chambers 10, 10*a* . . . can be appropriately changed in accordance with a required total number of dispersion. Further, it is possible to integrally form the small chamber structuring network body 12 together with the small chamber structuring network body 14.

The total number of dispersion means the number of dispersion of fluids which should be performed while the fluids pass through the small chambers 10, 10*a* . . . , which communicate with one another, of outer cylindrical unit body 3 and the inner cylindrical unit body 4. In case of the stationary type mixing apparatus 1 comprising the single fluid unit body 2, total number of dispersion is determined by the number of the small chambers 10, 10*a* . . . , while in case of the stationary type mixing apparatus 1 comprising the double fluid unit bodies 2 and 2*a*, it becomes a product of each total number of dispersion of the single fluid unit body 2.

In the stationary type mixing apparatus 1 connecting the double fluid unit bodies 2 and 2*a*, appropriate seal portions (not shown) are provided at connecting portions of the double fluid unit bodies 2 and 2*a* so as to prevent the fluids from being leaked out.

In the double fluid unit bodies 2 and 2*a*, the small diameter side of the inner cylindrical body 13 constituting the inner cylindrical unit body 4 may be opened so as to form a fluid passage D in the inner space of the inner cylindrical unit body 4. A connecting opening portion 16 of a medium supply pipe 15, through which a cooling or heating medium is supplied, projects axially from the opened end of the inner cylindrical body 13.

Both the outer cylindrical unit body 3 and the inner cylindrical unit body 4 may not integrally form the small chambers 10, 10*a* . . . but the small chamber structuring network bodies 12 and 14 may be separately formed.

In such an arrangement, it is preferable that each element is made of metallic materials which do not exert bad influence upon quality of the raw material and have high thermal conductivity, such as stainless steel, nickel bronze, tin, titanium, copper, aluminum, so as to improve the thermal efficiency at the time of cooling or heating the fluids by permitting each element to directly contact a cooling or heating medium so as to reduce heat generating operation when the raw materials are mixed or heat the raw materials. Particularly, if the raw materials are not necessary to be cooled or heated, plastics or ceramics may be employed although they are inferior to some extent than the aforementioned metallic materials in thermal efficiency.

An operation of the stationary type mixing apparatus 1 according to the present invention will be now described.

Raw material which was supplied to the stationary type mixing apparatus 1 by a given flow rate under pressure enters the passage space C between the outer cylindrical unit body 3 and the inner cylindrical unit body 4 from the large or small diameter opened end thereof and fluids of a plurality of kinds are mixed complicatedly by the small chambers 10, 10*a* . . . during the passage of the passage space C.

The mixing process will be now described. In the single fluid unit body 2, the fluids as the raw materials enter from the inlet at the large or the small diameter opened end which is upstream relative to the passage space C of the single fluid unit body 2, and pass through the small chambers 10, 10*a* . . . formed by the small diameter opened end portion of the inner cylindrical unit body 4. Then, the fluids strike aslant against the side surfaces 11*a* forming the tapered surfaces of the small chambers 10, 10*a* . . . so that they are varied in the flowing directions thereof and flow along the side surfaces 11*a*, and they are finally successively dispersed to enter the small chambers 10, 10*a* . . . which are located at downstream and formed by the small diameter end portion of the outer cylindrical unit body communicating one another with the small chambers 10, 10*a* . . .

The fluids further strike aslant against the inner peripheral surface 6*a* of the outer cylinder 6 serving as the bottom surfaces of the small chambers 10, 10*a* . . . so that they are changed in their flowing directions and flow along the inner peripheral surface 6*a*. Then, the fluids strike aslant again against the side surfaces 11*a* forming the tapered surfaces of the small chambers 10, 10*a* . . . so that they are varied in their flowing directions and flow along the side surfaces 11*a*, and then successively dispersed to enter the small chambers 10, 10*a* . . . which are located at downstream and formed by the inner cylindrical unit body 4 communicating with the small chambers 10, 10*a* . . . Thereafter, the fluids pass through the small chambers 10, 10*a* . . . and direct toward the large diameter or small diameter opened end in the passage space C of the diffusion element 5, where they are mixed complicatedly while being subjected to striking, dispersing, meandering, turning, joining, etc. and finally they are discharged from the exit of the small or large diameter opened end thereof.

In the double fluid unit bodies 2 and 2*a*, the mixing operations or phenomena in the single fluid unit body 2 are repeatedly performed, while the cooling or heating medium is permitted to enter into and circulate in the medium passage D serving as the inner space of the inner cylindrical unit body 4 so as to cool or heat the inner cylindrical unit body 4.

When the fluids pass through the upper end surfaces 11*b* of the side walls 11 forming the small chambers 10, 10*a* . . . , they are reduced in their shearing force at the time when they pass through the upper end surface 11*b* since the upper end surface 11*b* is radiused, and they are reduced also in an impact destructive force when they strike against the upper end surfaces 11*b*, so that they can flow smoothly. Similarly, since the connecting portions 11*c* and the crossing portion 11*d* are reversely radiused, the impact destructive force of the fluids can be reduced so that the fluids can flow smoothly.

As mentioned above, when the fluids are turned or changed in their flowing directions, striking directions of the fluids against the tapered side surface 11*a* formed on the side wall 11, the inner peripheral surface 6*a* of the outer cylindrical body 6, the outer peripheral surface 13*a* of the inner cylindrical body 13 are all aslant not perpendicular, so that the flowing resistance can be reduced and the mixing with high viscosity can be performed compared with the striking of fluids perpendicular to the surfaces of each element according to the prior art apparatus. As a result, it is possible to mix the fluids having high viscosity, and also possible to reduce the destruction, crush, etc. of the inner structure such as inner molecular or component particle, etc. of the fluids, which is caused by the impact destructive force of the fluids against the surface of each element.

Since the annular cross-sectional area of the passage space C or the inner capacities of the small chambers 10, 10*a* . . . are gradually greater from the small diameter opened end toward the large diameter opened end of the double fluid unit bodies 2 and 2*a*, pressure distribution inside the passage space C is decreased toward the large diameter opened end in inverse proportion to the annular cross-sectional area of the passage space C or the inner capacities of the small chambers 10, 10*a* . . . Because of the reduction of pressure, extension operation is given to the flowing fluids so that the orienting direction of the inner molecule or the component particle, etc. in the inner structure is directed to the axial direction of the stationary type mixing apparatus 1, while in the large diameter opened end, the external force is decreased, thereby reducing the increase of internal stress which occurs in the mixing process of the fluids.

On the other hand, in case of the entrance of the fluids from the large diameter opened end, compression operation which is inverse of the extension operation is given to the flowing fluids.

Raw material for foodstuff, raw material including high polymer material, plastics as synthetic high polymer material, raw material for ceramic ware as ceramic raw material are considered as the fluids.

In a word, the present invention comprises the large diameter outer cylindrical unit body 3 and the inner cylindrical unit body 4 wherein the latter is concentrically inserted into the inner space of the large diameter outer cylindrical unit body 3 so as to form the single fluid unit body 2 while forming the passage space C between the outer cylindrical unit body 3 and the inner cylindrical unit body 4. Accordingly, the pressure distribution in the passage space C is decreased toward the large diameter opened end.

Particularly, when the fluids enter from the small diameter opened end, extension operation is given to the flowing fluids because of the reduction of pressure toward the large diameter opened end so that each of the oftenting direction of the inner structures of the fluids is directed in the axial direction of the stationary type mixing apparatus 1. On the other hand, since the external force (pressure) is decreased at the large diameter opened end of the single fluid unit body 2, the increase of the internal stress which is generated in the course of mixture of the fluids can be reduced so as to facilitate the rolling of the noodles which requires rolling process after mixture. Further, when the fluids enter from the small diameter opened end, pressure is increased in the small diameter opened end, the fluids can be discharged in a dense state by the compression operation.

Since the plurality of small chambers 10, 10*a* . . . are arranged on the inner peripheral surface 6*a* of the outer cylindrical body 6 and opened at fronts thereof, wherein width of each side wall 11 forming each small chamber 10, 10*a* . . . is decreased toward an upper direction thereof, and a plurality of small chambers 10, 10*a* . . . are arranged on an outer peripheral surface 13*a* of the inner cylindrical body 13 and opened at fronts thereof, wherein width of each side wall 11 forming each small 10, 10*a* . . . is decreased toward an upper direction thereof, and wherein the small chambers 10, 10*a* . . . of the inner cylindrical unit body 4 and the small chambers 10, 10*a* . . . of the outer cylindrical unit body 3 are arranged alternately face to face so as to communicate with one another in a state where the inner cylindrical unit body 4 is concentrically inserted into the inner space of the outer cylindrical unit body 3, fluids pass through the small chambers 10, 10*a* . . . , which are communicating with one another, and successively flow from the upstream side of the passage space C of the fluid unit body 2 to the downstream side, so that sole or plural raw materials are effectively mixed by change of fluids such as aslant striking of the fluids against the tapered side surface 11*a*, the inner peripheral surfaces 6*a*, the inner peripheral surface 13*a*, and dispersion, joining, meandering of the fluids from the small chambers 10, 10*a* . . . toward the other small chambers 10, 10*a* . . . Further, since the striking direction against the side surface 11*a* of the side wall 11, the inner peripheral surface 6*a* of the outer cylindrical body 6 and the inner peripheral surface 13*a* of the outer cylindrical body 13 are all aslant at the time of turning of flowing direction during the flowing of the fluids, the flowing resistance can be reduced compared with the perpendicular striking against the surfaces of each element as performed in the prior art stationary type mixing apparatus, so that the fluids having high viscosity can be mixed, and destruction and crushing of the internal structures of fluids by the impact destructive force applied to the surfaces of each element can be reduced.

Since the large diameter opened ends of the double fluid unit bodies 2 and 2*a* are respectively coupled to each other, or the small diameter opened ends of the double fluid unit bodies 2 and 2*a* are respectively coupled to each other, or the large diameter opened end and the small diameter opened end of the double fluid unit bodies 2 and 2*a* are coupled to each other so as to communicate with the passage space C, the change of flowing direction caused by the dispersion, joining, meandering and turning of the fluids can be exponentially increased, so that the mixing efficiency can be further increased. When the large diameter opened ends of the double fluid unit bodies 2 and 2*a* are coupled to each other, the pressure distribution inside the passage space C is reduced toward the large diameter opened end so as to generate extension operation which is applied to the flowing fluids. Accordingly, the orienting direction of the internal structure is directed in the axial direction of the stationary type mixing apparatus 1. Further since the external force is reduced at the large diameter opened end of the single fluid unit body 2, the increase of the internal stress which is generated during the mixing process is reduced, and the destruction of the internal structure caused by mixture in the double fluid unit bodies 2 and 2*a* can be reduced. As a result, since the internal stress of the mixed fluids is not increased so that the rolling of the noodle which requires rolling process after mixture can be facilitated.

When the large diameter opened end and the small diameter opened end of the double fluid unit bodies 2 and 2*a* are coupled to each other, the extension operation applied to the flowing fluids can be repeated so that the oftenting property of the internal structures of the fluids can be further improved. Since the increase of the internal stress which is generating in the mixing process can be surely prevented, the rolling of the noodles which require the rolling process after mixture is further facilitated. When the small diameter opened ends of the double fluid unit bodies 2 and 2*a* are coupled to each other, the mixed fluids which are finally discharged from the large diameter opened end are reduced in their internal stress, so that the rolling of the noodles which require the rolling process after mixture is further facilitated.

Since the upper end surface 11*b* of the side wall 11 forming the small chambers 10, 10*a* . . . is radiused, the shearing force, which is generated when the fluids pass through the upper end surface 11*b*, is reduced, and the impact destructive force of the fluids when striking against the upper end surface 11*b* is also reduced. As a result, smooth flowing can be assured without destroying the internal structure.

Since the inner space of the inner cylindrical unit body 4 is formed as the medium passage D for the cooling or heating medium, the raw material is heated by the heating operation which is generated when the fluids are mixed inside the passage space C, however, the heat can be absorbed by the cooling medium which flows through the medium passage D. Accordingly, it is possible to prevent the raw material from being deteriorated in quality which is caused by thermal change, especially, when the raw material is foodstuff which has low resistance against the heat. Further, the present invention has a very advantageous practical effect in that the raw material can be effectively heated when the heating medium is permitted to flow through the medium passage D in case of the raw material which is to be heated during mixture thereof.

What is claimed is:

1. A stationary type mixing apparatus comprising a single fluid unit body composed of:

a frustoconical outer cylindrical unit body having a large diameter, said body including a frustoconical outer cylindrical body;

a frustoconical inner cylindrical unit body having a diameter being smaller than that of said outer cylindrical unit body, said body including a frustoconical inner cylindrical body;

wherein said inner cylindrical unit body is inserted concentrically in an inner space of said outer cylindrical unit body so as to form a passage space between said outer cylindrical unit body and said inner cylindrical unit body;

a first plurality of small chambers arranged on an inner peripheral surface of said outer cylindrical body and opened at fronts thereof, wherein width of each side wall forming each of said first plurality of small chambers is decreased toward an upper direction thereof;

a second plurality of small chambers arranged on an outer peripheral surface of said inner cylindrical body and opened at fronts thereof, wherein width of each side wall forming each of said second plurality-of small chambers is decreased toward an upper direction thereof; and wherein said first plurality of small chambers and said second plurality of small chambers are arranged alternately face to face so as to communicate with one another in a state where said inner cylindrical unit body is concentrically inserted into said inner space of said outer cylindrical unit body.

2. The stationary type mixing apparatus according to claim 1, wherein each upper end surface of each side wall forming said small chambers is radiused.

3. The stationary type mixing apparatus according to claim 1, wherein said inner cylindrical unit body has a medium passage in an inner space thereof through which cooling medium passes.

4. The stationary type mixing apparatus according to claim 1, wherein said inner cylindrical unit body has a medium passage in an inner space thereof through which heating medium passes.

5. A stationary type mixing apparatus comprising double fluid unit bodies, each of said double fluid unit bodies being composed of:

a frustoconical outer cylindrical unit body having a large diameter and including a frustoconical outer cylindrical body;

a frustoconical inner cylindrical unit body having a diameter smaller than that of said outer cylindrical unit body and including a frustoconical inner cylindrical body;

wherein said inner cylindrical unit body is inserted concentrically in an inner space of said outer cylindrical unit body so as to form a passage space between said outer cylindrical unit body and said inner cylindrical unit body;

wherein large diameter opened ends of said double fluid unit bodies are coupled to each other;

a first plurality of small chambers arranged on an inner peripheral surface of said outer cylindrical body and opened at fronts thereof, wherein width of each side wall forming each of said first plurality of small chambers is decreased toward an upper direction thereof;

a second plurality of small chambers arranged on an outer peripheral surface of said inner cylindrical body and opened at fronts thereof, wherein width of each side wall forming each of said second plurality of small chambers is decreased toward an upper direction thereof; and wherein said second plurality of small chambers and said first plurality of small chambers are arranged alternately face to face so as to communicate with one another in a state where said inner cylindrical unit body is concentrically inserted into said inner space of said outer cylindrical unit body.

6. The stationary type mixing apparatus according to claim 1, wherein a small diameter opened end of said single fluid unit body and a small diameter opened end of another single fluid unit body are coupled to each other.

7. The stationary type mixing apparatus according to claim 1, wherein a large diameter opened end of said single fluid unit body is coupled to a small diameter opened end of another of said single fluid unit body.

8. The stationary type mixing apparatus according to claim 5, wherein each upper end surface of each side wall forming said small chambers is radiused.

9. The stationary type mixing apparatus according to claim 5, wherein said inner cylindrical unit body has a medium passage in an inner space thereof through which cooling medium passes.

10. The stationary type mixing apparatus according to claim 5, wherein said inner cylindrical unit body has a medium passage in an inner space thereof through which heating medium passes.

* * * * *